United States Patent [19]

Ohashi

[11] 4,130,963

[45] Dec. 26, 1978

[54] RUNNING TOY WITH A FLYWHEEL

[75] Inventor: Yutaka Ohashi, Mibu, Japan

[73] Assignee: Tonka Corporation, Hopkins, Minn.

[21] Appl. No.: 805,511

[22] Filed: Jun. 10, 1977

[30] Foreign Application Priority Data

Jul. 13, 1976 [JP] Japan ..... 51-93510[U]
Feb. 28, 1977 [JP] Japan ..... 52-24264[U]

[51] Int. Cl.[2] ..... A63H 29/20
[52] U.S. Cl. ..... 46/209
[58] Field of Search ..... 46/201, 204, 206, 207, 46/209, 50

[56] References Cited

U.S. PATENT DOCUMENTS

| | | | |
|---|---|---|---|
| 806,977 | 12/1905 | Kingsbury | 46/209 |
| 3,546,809 | 12/1970 | Nielsen | 46/206 |
| 3,798,831 | 3/1974 | Higashi | 46/206 |
| 4,059,918 | 11/1977 | Matsushiro | 46/209 |

FOREIGN PATENT DOCUMENTS

| | | | |
|---|---|---|---|
| 1394867 | 1/1965 | France | 46/206 |

*Primary Examiner*—Russell R. Kinsey
*Assistant Examiner*—Mickey Yu
*Attorney, Agent, or Firm*—Norman P. Friederichs

[57] ABSTRACT

The running toy with a flywheel of the invention has a toy driving unit to form a first transmission path with a first gear ratio to energize and rotate the flywheel at a high speed when driving wheels are rubbed against a floor for drive, and a second transmission path to rotate the driving wheels with the flywheel as a drive source at a speed reduced by a second gear ratio different from the first gear ratio when the drive of the driving wheels is stopped, thereby running the running toy at a speed different from the speed at time of energizing of the flywheel, a frictional rotation transmitting section provided in the second transmission path to yield a slip when the driving wheels are applied with overload.

10 Claims, 5 Drawing Figures

RUNNING TOY WITH A FLYWHEEL

BACKGROUND OF THE INVENTION

This invention relates to a running toy with a flywheel in which the driving wheels are driven to rotate and energize the flywheel at a high speed, and then the driving wheels are rotated making use of the rotation by inertia of the flywheel, thereby running the toy.

There have conventionally been known running toys making use of the rotation by inertia of the flywheel as stated above. However, such conventional toys have been subject to various defects. For example, a first defect is that the running toy cannot move at a speed higher than the speed corresponding to the rotating speed of the driving wheels yielded by the flywheel because the flywheel and the driving wheels are coupled securely by a set of gear train. Accordingly, when the flywheel is energized by rubbing the toy automobile against e.g. a floor surface, the running speed of the toy automobile driven by the flywheel is equal to or lower than the moving speed of the toy automobile at energizing of the flywheel.

Meanwhile, a second defect is that as the flywheel and the driving wheels are coupled securely by the gear train, so, when the driving wheels are stopped while the toy automobile is running or applied with overload, the rotating parts on their relevant portions may be distorted by the large energy of rotation possessed by the flywheel or the teeth of the gears used may be broken.

SUMMARY OF THE INVENTION

A first object of this invention is to provide a running toy with a flywheel free from the aforesaid defects possessed by the conventional running toys with flywheel in which the driving wheels start rotation at a speed different from the rotating speed of the driving wheels at energizing the flywheel, thus allowing the running toy to start running at a speed different from the moving speed equivalent to the rotating speed of the driving wheels at energizing of the flywheel.

This invention provides a running toy which will not be subject to distortion of any rotating parts or their relevant portions or break of any teeth of the gears used even if the driving wheels are applied with overload or stopped while running.

The running toy with a flywheel of this invention is provided with a body; a base attached to the body, and a toy driving unit mounted on the base; the toy driving unit having a frame, at least one driving wheel, a flywheel, and a gear mechanism attached to the frame to support and couple the driving wheel and the flywheel, the gear mechanism forming a first transmission path with a first gear ratio to energize the flywheel so as to rotate the flywheel at a high speed when the driving wheel is driven, and a second transmission path with a second gear ratio to rotate the driving wheel through the flywheel at a speed lower than the rotating speed of the flywheel when the drive of the driving wheels is stopped, thereby rotating the driving wheels at a rotating speed different from that at time of energizing the flywheel.

The running toy with the above-mentioned construction of this invention may be run at a speed different from higher orlower speed than the energizing speed when the running toy is rubbed against e.g. a floor surface by selecting the first and second gear ratios properly. Further, by providing the second transmission path of the running toy with a rotation transmitting section employing a friction coupling, the large torque, which may be produced according to the high-speed rotation of the flywheel when the driving wheels of the running toy are applied with overload or stopped, can be dissipated through the friction coupling, thereby avoiding damage to the relevant portions.

DETAILED DESCRIPTION OF THE PREFERRED EMBODIMENT

Referring now to FIGS. 1 to 5, there will be described an embodiment of the invention. In the embodiment, the invention is applied to a toy automobile.

Figure 1:
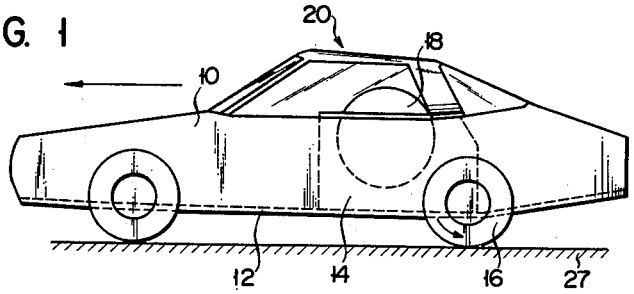
FIG. 1 is a side view of the toy automobile with a flywheel according to this invention.

In FIG. 1, numeral 10 denotes a body; 12 a base or chassis, 14 a toy driving unit (hereinafter referred to simply as the driving unit) mounted on the chassis 12. Driving wheels 16, 16 and a flywheel 18 are mounted on the driving unit 14. When a toy automobile 20, held by hand, is moved forward or in the direction as indicated by the arrow at a suitable speed or an energizing speed so that the driving wheels 16 may be rubbed against e.g. a floor surface 27, the flywheel 18 is rotated through a gear mechanism provided in the driving unit 14 at a high speed corresponding to such energizing speed. When the automobile 20 is immediately placed on the floor, the driving wheel 16 is driven by the flywheel 18 already rotating at a high speed to rotate in the same direction as that of the rotation accompanying the energizing of the flywheel 18, thereby allowing the automobile 20 to start running in the direction indicated by the arrow.

Figure 2:
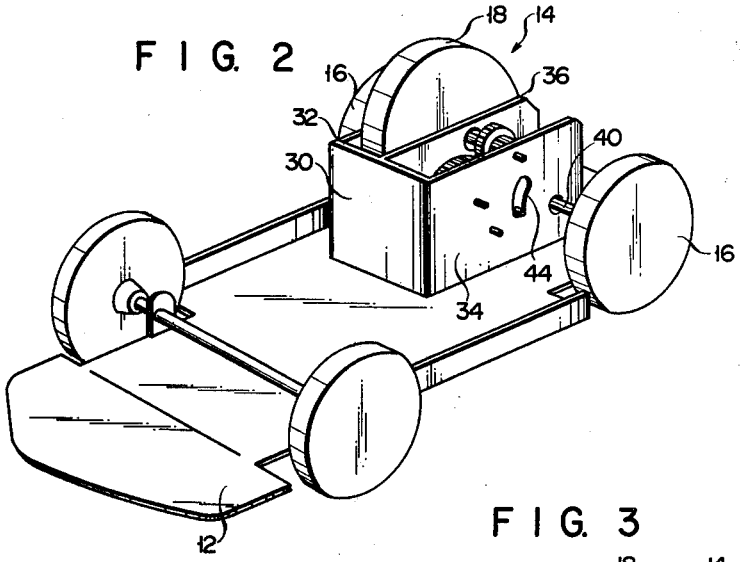
FIG. 2 is a perspective view of a portion of the toy automobile of FIG. 1 cleared of the body.
Figure 3:
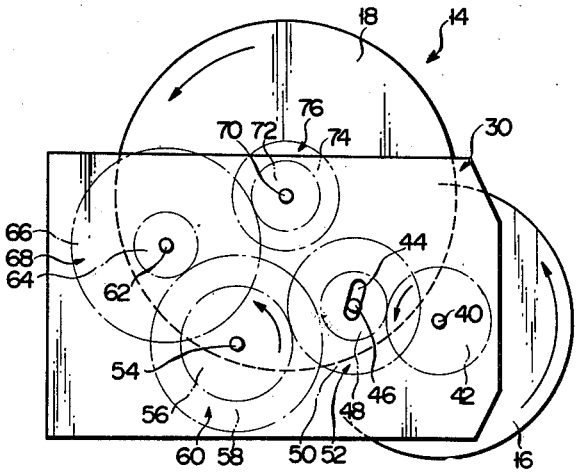
FIG. 3 is a lateral diagram illustrating the gearing system of the toy driving unit used with the toy automobile of FIG. 1.
Figure 4:
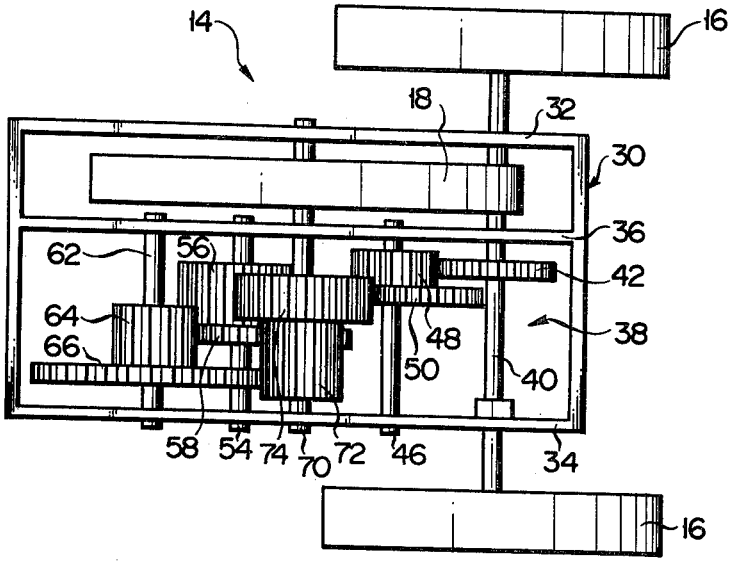
FIG. 4 is a plan view of the toy driving unit of FIG. 3.

FIG. 2 shows a remaining portion of the toy automobile 20 of FIG. 1 cleared of the body 10. In FIGS. 2, 3 and 4, numeral 30 denotes a frame mounted on the chassis 12 which has side walls 32 and 34 and a partition wall 36 extending in the longitudinal direction of the automobile 20 or the chassis 12.

The driving unit 14 (FIG. 4) has the flywheel 18, the driving wheels 16, 16, and a gear mechanism 38 for coupling these members 18 and 16, 16. The gear mechanism 38 is provided with a driving shaft 40 borne by the side walls 32 and 34 of the frame 30. A first gear member or first gear 42 is fixed to the driving shaft 40. A movable shaft 46 is borne by slots 44 (FIGS. 3 and 4) bored in the partition wall 36 and the side wall 34 along an arc about the driving shaft 40. The shaft 46 is capable of shifting along such slots 44. The gear mechanism 38 has a second gear member 52 (FIG. 3) composed of a second gear 48 fixed to the movable shaft 46, drivingly engaged with the first gear 42, and having fewer teeth as compared with the gear 42. The second gear 48 is capable of moving engagedly around the first gear 42 within a range defined by the slots 44. The second gear member 52 further includes a third gear 50 formed coaxially and integrally with the gear 48 and having more teeth as compared with the second gear 48. A rotary shaft 54 is borne by the partition wall 36 and the side wall 34. A third gear member 60 is provided composed of a fourth gear 56 engaged with the third gear 50 when the second gear member 52 is shifted along the slots 44 to the counterclockwise end thereof as in FIG. 3 together with the movable shaft 46. The gear 56 has fewer teeth as compared with the gear 50. The a fifth gear 58 is formed coaxially and integrally with the gear 56 and having more teeth as compared with the fourth gear 56; a rotary shaft 62 is born by the partition wall 36 and the side wall 34. A gear train 68 composed of a sixth gear 64 is fixed to the rotary shaft 62. The gear 64 is engaged with the fifth gear 58 and has fewer teeth as compared with the gear 58. A seventh gear 66 is formed coaxially and integrally with the sixth gear 64 and has more teeth as compared with the sixth gear 64; a flywheel shaft 70 is borne by the side walls 32 and 34. A fourth gear member 76 is composed of an eighth gear 72 fixed to the flywheel shaft 70. Gear 72 is engaged with the seventh gear 66 and has fewer teeth as compared with the gear 66. A ninth gear 74 is formed coaxially and integrally with the gear 72 and has more teeth as compared with the eighth gear 72.

Now I will describe the operation of the driving unit 14. When the driving wheels 16 are rotated in the direction as indicated by the arrows in FIGS. 1 and 3 or counterclockwise in such a manner as mentioned with reference to FIG. 1, the first gear 42 also rotates counterclockwise to rotate the second gear 48 clockwise, thereby impelling the member 52 as a whole counterclockwise along the slots 44. Accordingly, the third gear 50 gets engaged with the fourth gear 56, and thereafter the flywheel shaft and hence the flywheel 18 is rotated in the direction as indicated by the arrow through the fifth gear 58, sixth gear 64, seventh gear 66, and the eighth gear 72. Considering the relation among the numbers of teeth of the respective gears as described above, it may be clear that the flywheel 18 rotates faster than the driving wheel does. Thus formed rotation transmission path will be referred to as the first transmission path in distinction from another transmission path as mentioned below, while the ratio of the rotating speeds of the flywheel 18 to the driving wheels 16 in such first transmission path will be called the first gear ratio hereinafter.

Meanwhile, when the drive from the driving wheels 16 is stopped, the driving wheels 16, in turn, are rotated by the flywheel 18 charged with a large energy of rotation as a drive source. When the flywheel 18 rotates as a drive source, the first transmission path is driven to rotate the fourth gear 56 in the direction indicated by the arrow or counterclockwise. When the fourth gear 56 rotates in such direction, the third gear 50 is rotated clockwise and pushed substantially upward at the same time, thereby shifting the movable shaft 46 furnished with the gear 50 clockwise along the slots 44. Thus, the third gear 50 leaves the fourth gear 56 to get engaged directly with the ninth gear 74 fixed to the flywheel shaft 70. By such engagement, the energy of the rotation of the flywheel 18 rotates the driving wheels 16 in the direction as indicated by the arrow through the ninth gear 74, third gear 50, second gear 48, and the first gear 42. Here, the transmission path to transmit the rotation of the flywheel 18 to the driving wheels 16 is called the second transmission path, while the ratio of the rotating speed of the flywheel 18 to that of the driving wheels 16 in such transmission path is called the second gear ratio. Varying the relative values of the first and second gear ratios, the rotating speed of the driving wheels 16 at the start of running of the toy automobile may be rendered different from or higher or lower than the rotating speed of the driving wheels 16 at energizing the flywheel 18. In the toy driving unit 14 as shown in FIG. 3, however, there is illustrated a case in which the relation between the two gear ratios is so fixed that the rotating speed of the driving wheels 16 at the start of running of the toy automobile is lower than the rotating speed of the flywheel 18 but higher than that at energizing the flywheel 18. Thus, it is possible to initiate running at a speed higher than the forward moving speed of the toy automobile 20 at which the driving wheels 16 of such automobile 20 in FIG. 1 is rubbed against the floor and energized.

Figure 5:
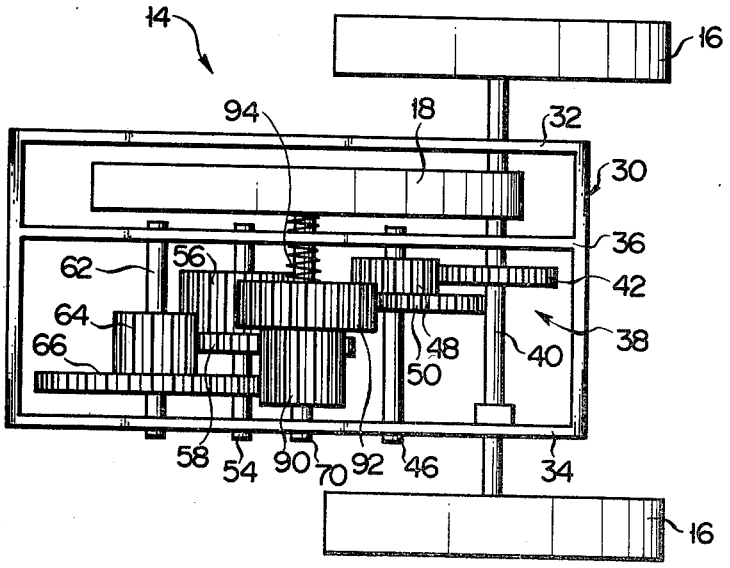
FIG. 5 is a modified drawing of the toy driving unit of FIG. 4.

FIG. 5 shows a modification of the embodiment as shown in FIG. 4. In this modification, there are used a first high-speed gear 90 and a second high-speed gear 92 as shown in FIG. 5 in place of the eighth and ninth gears 72 and 74 formed integrally as the fourth gear member 76 in the aforementioned embodiment, and a coil spring 94 is employed for thrusting the second high-speed gear 92 against the first high-speed gear 90. Since the details of other parts are the same with the aforementioned embodiment, I will mainly describe the above-stated differences hereinafter.

The first high-speed gear 90 is engaged with the seventh gear 66, has fewer teeth as compared with the gear 66, and is fixed to the flywheel shaft 70. The second high-speed gear 92 is loosely penetrated by the flywheel shaft 70 and thrusted against the first high-speed gear 90 by the coil spring 94 put on the shaft 70, thereby forming a frictional rotation transmitting means. When the acceleration of the flywheel 18 is completed and the flywheel 18 becomes the drive source, the third gear 50 shifts clockwise round the driving shaft 40 as mentioned above to get engaged with the second high-speed gear 92. Accordingly, the rotation of the flywheel 18 is transmitted to the driving wheel 16 through the second high-speed gear 92 rotated by the frictional rotation transmission between the first and second high-speed gears 90 and 92 as well as the second transmission path composed of the third gear 50, the second gear 48, and the first gear 42. Here, if the driving wheels 16 are stopped suddenly or applied with overload, the first and second high-speed gears 90 and 92 will slip on each other to prevent excessive torque to be applied to any rotating parts. That is, there will be avoided such troubles as damage to the teeth of any gears and breakage of any other fragile portions.

What is claimed is:

1. A running toy with a flywheel comprising a body, a base attached to said body, and a toy driving unit mounted on said base; said toy driving unit having a frame, at least one driving wheel, a flywheel, and a gear mechanism attached to said frame to couple said driving wheel and said flywheel, said gear mechanism forming a first transmission path with a first gear ratio to energize said flywheel so as to rotate said driving wheel at a first speed as compared to the flywheel when said driving wheel is driving said flywheel, and a second transmission path with a second gear ratio to rotate said driving wheel through said flywheel at a second speed as compared to the rotating speed of said flywheel when the driving wheel is driven by the flywheel, thereby rotatably driving said wheel at a speed different from that at time of energizing said flywheel.

2. A running toy with a flywheel comprising a body, a base attached to said body, and a toy driving unit mounted on said base; said toy driving unit having a frame, at least one driving wheel, a flywheel, and a gear mechanism attached to said frame to couple said driving wheel and said flywheel, said gear mechanism comprising a driving shaft borne by said frame and fixed to said driving wheel, a first gear member fixed to said driving shaft, a movable shaft so borne as to be able to shift along slots formed on said frame along circles round said driving shaft, a second gear member fixed to said movable shaft and engaged with said first gear member, a rotary shaft borne by said frame, a third gear member fixed to said rotary shaft, a flywheel shaft borne by said frame and fixed with said flywheel, a fourth gear member fixed to said flywheel shaft, and a gear train for coupling said third gear member to said fourth gear member; and gear mechanism shifting said movable shaft to one end of each of said slots to engage said second and third gear members with each other, thereby forming a first transmission path, when said driving wheel is driven, while shifting said movable shaft to the other end of each of said slots to engage said second gear member with said fourth gear member, thereby forming a second transmission path, when the drive of said driving wheel is stopped.

3. A running toy according to claim 2 wherein said first gear member has a first gear, said second gear member has a second gear engaged with said first gear and a third gear formed coaxially and integrally with said second gear, said third gear member has a fourth gear engaged with said third gear and a fifth gear formed coaxially and integrally with said fourth gear, said gear train has a sixth gear engaged with said fifth gear and a seventh gear formed coaxially and integrally with said sixth gear, and said fourth gear member has an eighth gear engaged with said seventh gear and a ninth gear formed coaxially and integrally with said eighth gear.

4. A running toy according to claim 1 wherein said gear mechanism comprises an driving shaft borne by said frame and fixed to said driving wheel, a first gear member fixed to said driving shaft, a movable shaft so borne as to be able to shift along slots formed on said frame along circles round said driving shaft, a second gear member fixed to said movable shaft and engaged with said first gear member, a rotary shaft borne by said frame, a third gear member fixed to said rotary shaft, a flywheel shaft borne by said frame and fixed with said flywheel, a first high-speed gear fixed to said flywheel shaft and engaged with said third gear member, a second high-speed gear loosely penetrated by said flywheel shaft and trusted by said first high-speed gear to rotate through frictional coupling with said first high-speed gear, and a gear train for coupling said third gear member to said first high-speed gear; said gear mechanism shifting said movable shaft to one end of each of said slots to engage said second and third gear members with each other, thereby forming said first transmission path, when said driving wheel is driven, while shifting said movable shaft to the other end of each of said slots, thereby forming said second transmission path, when the drive of said driving wheel is stopped, so that said frictional coupling may slip when said driving wheel is applied with a load or torque exceeding a prescribed level.

5. A running toy according to claim 4 wherein said first gear member has a first gear, said second gear member has a second gear engaged with said first gear and a third gear formed coaxially and integrally with said second gear, said third gear member has a fourth gear engaged with said third gear and a fifth gear member formed coaxially and integrally with said fourth gear, and said gear train has a sixth gear engaged with said fifth gear and a seventh gear formed coaxially and integrally with said sixth gear and engaged with said first high-speed gear.

6. A running toy with a flywheel, said toy comprising:

a body;

a base member attached to said body; and a toy driving unit mounted on said base, said toy driving unit having a frame, at least one driving wheel, a flywheel, and a gear mechanism attached to said frame to couple said driving wheel and said flywheel, said gear mechanism including a first transmission path with a first gear ratio to energize said flywheel as said driving wheel is rubbed against a surface while in an energizing mode, said gear mechanism including a second transmission path with a second gear ratio to provide a driving force to said wheel while in a driving mode, said gear mechanism further including means to change said gear mechanism from said first transmission path to said second transmission path and from said second transmission path.

7. The running toy of claim 6 wherein said second gear ratio provides a greater rotational rate to said wheel than the rotational rate of said wheel when in said energizing mode.

8. The running toy of claim 6 wherein said change means comprise a shaft having gear means mounted thereon, said shaft being supported adjacent either end in wall means having slots defined therein, said shaft being disposed in said slot for movement from a first position in which said gear mechanism is engaged in said first transmission path to a second position in which said gear mechanism is engaged in said second transmission path.

9. The running toy of claim 8 wherein said gear mechanism includes slip means to prevent excessive torque from being applied to rotating parts.

10. The running toy of claim 9 wherein said slip means comprise a first gear, a second gear and a thrust spring, said first gear being rotatable with respect to said second gear, said thrust spring urging said first gear against said second gear to yieldably resist relative rotation.

* * * * *